US010018169B2

(12) United States Patent
Koeninger

(10) Patent No.: US 10,018,169 B2
(45) Date of Patent: Jul. 10, 2018

(54) NOZZLE ASSEMBLY FOR A FUEL INJECTOR, AND FUEL INJECTOR

(71) Applicant: Robert Bosch GmbH, Stuttgart (DE)

(72) Inventor: Andreas Koeninger, Neulingen-Goebrichen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/313,585

(22) PCT Filed: Apr. 13, 2015

(86) PCT No.: PCT/EP2015/057961
§ 371 (c)(1),
(2) Date: Nov. 23, 2016

(87) PCT Pub. No.: WO2015/180883
PCT Pub. Date: Dec. 3, 2015

(65) Prior Publication Data

US 2017/0184065 A1 Jun. 29, 2017

(30) Foreign Application Priority Data

May 26, 2014 (DE) ..... 10 2014 209 961

(51) Int. Cl.
*F02M 61/20* (2006.01)

(52) U.S. Cl.
CPC ..... *F02M 61/20* (2013.01); *F02M 2200/28* (2013.01)

(58) Field of Classification Search
CPC ..... F02M 61/20; F02M 2200/28; F02M 63/0056; F02M 69/36
(Continued)

(56) References Cited

U.S. PATENT DOCUMENTS 6,705,551 B1 * 3/2004 Kienzler ..... F02M 47/02 239/533.11
7,946,509 B2 * 5/2011 Boecking ..... F02M 47/027 123/445

(Continued)

FOREIGN PATENT DOCUMENTS

DE 102009001704 9/2010
DE 102011076665 12/2012

(Continued)

OTHER PUBLICATIONS

International Search Report for Application No. PCT/EO2015/057961 dated Jun. 12, 2015 (English Translation, 3 pages).

*Primary Examiner* — Hai Huynh
(74) *Attorney, Agent, or Firm* — Michael Best & Friedrich LLP

(57) ABSTRACT

A nozzle assembly for a fuel injector includes a nozzle needle (1), which is accommodated in a high-pressure bore (2) of a nozzle body (3) in such a way that the nozzle needle can be moved in a reciprocating manner in order to open and close at least one injection opening (4) and to which a spring force of a spring (5) is applied at least indirectly in a closing direction. The nozzle needle (1) is at least partially surrounded by a throttle bore body (7) in order to form at least one closing throttle (6). The throttle bore body (7) has a multi-part design and comprises at least two sleeves (7.1, 7.2), which are at least partially guided in each other.

16 Claims, 1 Drawing Sheet

(58) Field of Classification Search
USPC ..... 123/470
See application file for complete search history.

(56) References Cited

U.S. PATENT DOCUMENTS

| | | | | |
|---|---|---|---|---|
| 8,201,543 | B2 * | 6/2012 | Morris | F02M 51/0603 123/494 |
| 2007/0152084 | A1 * | 7/2007 | Boecking | F02M 51/0603 239/533.2 |
| 2010/0006675 | A1 * | 1/2010 | Boecking | F02M 51/0603 239/533.2 |

FOREIGN PATENT DOCUMENTS

| | | |
|---|---|---|
| WO | 2008015039 | 2/2008 |
| WO | 2009132879 | 11/2009 |

* cited by examiner

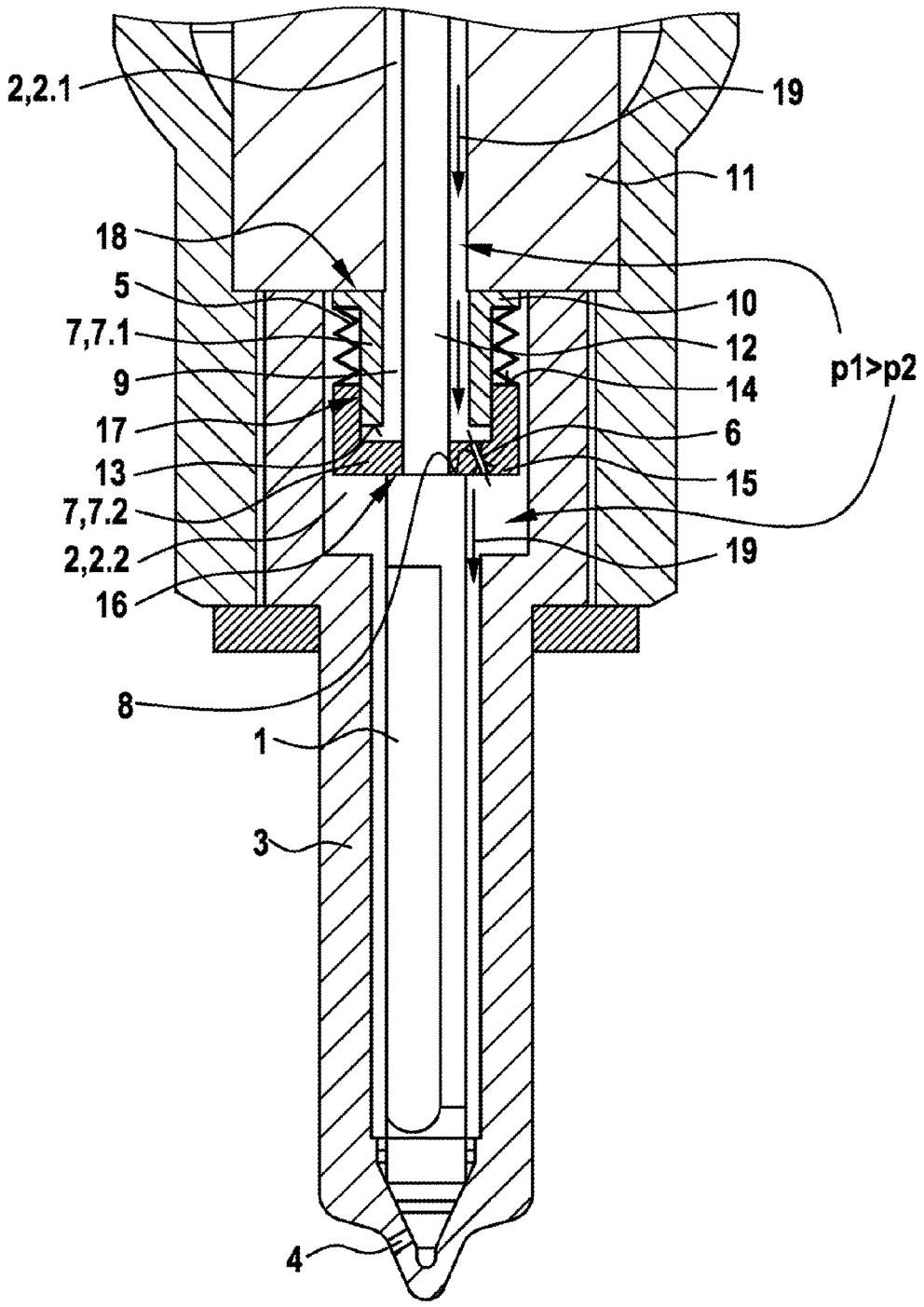
2,2.1
19
11
18
5
10
7,7.1
12
9
14
p1>p2
17
6
13
15
7,7.2
2,2.2
19
16
8
1
3
4

NOZZLE ASSEMBLY FOR A FUEL INJECTOR, AND FUEL INJECTOR

BACKGROUND OF THE INVENTION

The invention relates to a nozzle assembly for a fuel injector for injecting fuel into the combustion chamber of an internal combustion engine. Furthermore, the invention relates to a fuel injector having a nozzle assembly of this type.

Laid-open specification DE 10 2011 076 665 A1 has disclosed a nozzle assembly for a fuel injector for injecting fuel into a combustion chamber of an internal combustion engine, which nozzle assembly comprises a nozzle needle which is received in a high pressure bore of a nozzle body such that it can perform stroke movements in order to open and close at least one injection opening. The nozzle needle is loaded in the closing direction by the spring force of a closing spring which is supported on one side on a body component of the fuel injector and on the other side on a throttle bore body which surrounds the nozzle needle in regions. The throttle bore body in turn is supported on a shoulder of the nozzle needle. At least one throttle bore is configured in the throttle bore body, which throttle bore serves as a closing throttle and divides the high pressure bore into a first and a second part region. A hydraulic pressure p1 prevails in the first part region which lies upstream in the flow direction of the fuel in relation to the second part region, and a hydraulic pressure p2 prevails in the second part region, which hydraulic pressure p2 is smaller than p1, since the fuel has to pass the throttle bore, in order to pass from the first part region into the second part region during an injection operation. At the same time, the throttle bore body which surrounds the nozzle needle in regions has a hydraulically active area A1 which delimits the first part region and is larger than a hydraulically active area A2 which delimits the second part region. Said measures, in each case on their own or in combination, lead to a hydraulic pressure force which acts in the closing direction in addition to the spring force of the closing spring and accelerates the closing operation being generated on the throttle bore body and therefore on the nozzle needle.

The throttle bore body from DE 10 2011 076 665 A1 which surrounds the nozzle needle is pressed against a shoulder of the nozzle needle via the spring force of the closing spring and the additionally acting hydraulic pressure force, with the result that there is a high sealing action in the contact region. Bypass leakage paths which nullify the effect of the at least one throttle bore again at least partially can be produced, however, in the region of the guide of the throttle bore body within the high pressure bore.

SUMMARY OF THE INVENTION

The present invention is based on the object of specifying a nozzle assembly with a closing throttle which is optimized in terms of the degree of efficiency. Furthermore, the nozzle assembly is to be capable of being produced simply and inexpensively.

The object is achieved by way of a nozzle assembly according to the invention. Furthermore, a fuel injector having a nozzle assembly according to the invention is proposed for achieving the object.

The nozzle assembly which is proposed for a fuel injector comprises a nozzle needle which is received in a high pressure bore of a nozzle body such that it can perform stroke movements for opening and closing at least one injection opening and is loaded in the closing direction at least indirectly by the spring force of a spring. The nozzle needle is surrounded in regions by a throttle bore body in order to configure at least one closing throttle, which throttle bore body is configured in multiple pieces according to the invention and comprises at least two sleeves which are guided into one another at least in regions. The guiding of the sleeves into one another displaces the leakage-afflicted guide region radially to the inside, with the result that the leakage is reduced merely by the reduced guide diameter. An annular gap which permits mounting of the sleeves in a floating manner in the radial direction preferably remains between the sleeves of the throttle bore body and the nozzle body. The floating mounting in the radial direction makes it possible to compensate for manufacturing and/or assembly tolerances; in particular, an axial offset of the nozzle needle longitudinal axis in relation to a sealing seat can be compensated for. Furthermore, the annular gap between the sleeves and the nozzle body brings it about that the pressure p2 prevails radially on the outside and the pressure p1 prevails radially on the inside. Since p2 is smaller than p1, the sleeves are pressed against one another in the radial direction, with the result that the leakage in the region of the guide is reduced further in this way. Moreover, the guide play between the two sleeves can be minimized in a simple way by way of a corresponding material selection and/or processing, in order to keep the leakage as low as possible and to increase the degree of efficiency of the closing throttle.

The closing throttle is preferably configured in the sleeve which is arranged closer to the injection opening. By way of said measure, the hydraulic volume of the second part region of the high pressure bore can be reduced and the mechanical force transmission path can be shortened, which has a favorable effect on the response behavior of the moving components and therefore promotes rapid needle closure. An axially or obliquely running bore is further preferably provided in the sleeve for configuring the closing throttle. Said measure serves to optimize the flow in the region of the closing throttle.

The sleeve which is arranged closer to the injection opening is advantageously of substantially pot-shaped configuration. That is to say, it has a bottom region and a hollow-cylindrical section which is attached to the latter. It is proposed, furthermore, that the sleeve which is arranged closer to the injection opening surrounds the further sleeve at least in regions. That is to say, the pot-shaped sleeve guides the further sleeve, the pressure p1 prevailing on the inner circumferential side on the further sleeve and the pressure p2 prevailing on the outer circumferential side on the pot-shaped sleeve. The pressure difference leads to radial widening of the guided sleeve, with the result that the guide play between the two sleeves is minimized.

It is proposed in one development of the invention that the sleeve which is arranged closer to the injection opening is supported in the axial direction on a preferably annular shoulder of the nozzle needle. In order to configure a preferably annular shoulder, the nozzle needle can be of stepped configuration and/or can be assembled from a plurality of parts with different external diameters. The sleeve in turn preferably has a supporting face which bears against the shoulder and can be configured, for example, on a bottom region of a sleeve of pot-shaped configuration. Here, the sleeve engages behind the nozzle needle.

The pressure difference in the two part spaces of the high pressure bore brings about a hydraulic pressure force in the axial direction, by means of which the sleeve which is supported on the nozzle needle is pressed against the shoulder of the nozzle needle. The sealing action in the contact region of the sleeve with the nozzle needle is optimized by way of the axial force which acts in the direction of the shoulder, with the result that a further possible leakage path is closed.

In order to further increase the hydraulic pressure force which acts in the direction of the shoulder of the nozzle needle, the hydraulic active area, facing the first part region, of the sleeve which is supported on the nozzle needle can be greater than the hydraulic active area which faces the second part region of the high pressure bore.

It is proposed as an alternative or in addition that the sleeve is loaded by the spring force of the spring in the direction of the preferably annular shoulder of the nozzle needle, the spring force of which spring loads the nozzle needle in the closing direction. The sleeve therefore replaces a spring collar which is configured on the nozzle needle or is connected to the nozzle needle. The spring is preferably supported on an annular end face of the sleeve.

An annular space is preferably configured between the nozzle needle and the further sleeve which is arranged less closely to the injection opening. The annular space makes a flow of fuel possible in the direction of the at least one injection opening.

The further sleeve advantageously has a collar section for housing-side support. The collar section preferably extends radially to the outside. In this way, the collar section can serve as a spring collar for supporting the spring, the spring force of which loads the nozzle needle in the closing direction, preferably indirectly via the other sleeve which is supported on the nozzle needle. The sleeve is further preferably mounted in the high pressure bore in a radially floating manner, in order to compensate for any manufacturing and/or installation tolerances. The floating mounting in the radial direction can be realized in a simple way via the collar section of the sleeve for housing-side support.

It is proposed, furthermore, that the spring, the spring force of which loads the nozzle needle directly or indirectly in the closing direction, is arranged so as to lie radially on the outside in relation to at least one sleeve. Accordingly, fuel does not flow through the spring. In this way, flow forces on the moving components are prevented, which flow forces might impair the function of said components.

According to one preferred embodiment of the invention, the nozzle needle is of stepped configuration. The stepped configuration simplifies the configuration of an annular shoulder for supporting a sleeve of the throttle bore body which is configured in multiple pieces. The nozzle needle further preferably has a reduced external diameter in the region of a section which is surrounded by the throttle bore body. This ensures that a sleeve which is supported on said shoulder is pressed against the shoulder in the flow direction of the fuel via the hydraulic pressure force which additionally acts in the closing direction.

Furthermore, the throttle bore body which is configured in multiple pieces can be such that the sleeves interact so as to form a stroke stop. The stroke stop limits the stroke of the nozzle needle, which likewise has an advantageous effect on rapid needle closure. For example, a bottom face of a pot-shaped first sleeve can serve as first stop face, and an annular end face of a second sleeve which is guided in the first sleeve can serve as second stop face.

Moreover, a fuel injector is proposed for injecting fuel into the combustion chamber of an internal combustion engine with a nozzle assembly according to the invention. The multiple-piece throttle bore body is preferably supported here via one of its sleeves on a body component of the fuel injector, for example a holding body or an intermediate plate. The body component is preferably of plate-shaped configuration and has a central recess for receiving the nozzle needle or a pressure pin which can be coupled to the nozzle needle. The central recess in the body component further preferably serves at the same time as an inflow channel. Accordingly, the recess preferably has an internal diameter which is greater than the external diameter of the nozzle needle or of the pressure pin in this region.

BRIEF DESCRIPTION OF THE DRAWINGS

One preferred embodiment of the invention will be explained in greater detail in the following text using the appended drawing.

FIG. 1 shows a diagrammatic longitudinal section through a nozzle assembly according to the invention.

DETAILED DESCRIPTION

The nozzle assembly which is shown comprises a nozzle needle 1 which is received in a high pressure bore 2 of a nozzle body 3 such that it can perform stroke movements. At least one injection opening 4 can be opened and closed by the stroke movement of the nozzle needle 1. When the injection opening 4 is open, highly pressurized fuel is injected into a combustion chamber of an internal combustion engine (not shown).

The nozzle needle 1 is loaded in the closing direction by the spring force of a spring 5 which to this end is supported on one side on a collar section 10 of a first sleeve 7.1 and on the other side on an annular end face 14 of a pot-shaped second sleeve 7.2 of a throttle bore body 7 which is configured in multiple pieces. A throttle bore which runs obliquely through a bottom region 15 of the sleeve 7.2 is configured in the pot-shaped second sleeve 7.2 as a closing throttle 6 which is part of the flow path of the fuel to be injected. The closing throttle 6 brings it about that the hydraulic pressure p1 in a first part region 2.1 of the high pressure bore 2 is greater than the hydraulic pressure p2 in a second part region 2.2 of the high pressure bore 2. The pressure difference in turn leads to a hydraulic force which acts in the closing direction and loads the pot-shaped sleeve 7.2 and, indirectly via the pot-shaped sleeve 7.2, the nozzle needle 1. Together with the spring force of the spring 5, the hydraulic force brings about rapid needle closure.

To this end, the pot-shaped sleeve 7.2 is supported on an annular shoulder 8 of the nozzle needle 1 and is prestressed axially in the direction of the shoulder 8 by means of the spring force of the spring 5. The spring force of the spring 5 and the hydraulic force which acts in the closing direction bring about a sealing force which largely prevents a leakage in the contact region 16 of the sleeve 7.2 with the nozzle needle 1.

The pot-shaped sleeve 7.2 surrounds the further sleeve 7.1 of the multiple-piece throttle bore body 7 in regions, with the result that said further sleeve 7.1 is guided via the pot-shaped sleeve 7.2. The guide region 17 represents a further contact region which is as a rule afflicted by leakage. In the present case, however, the pressure conditions in the part regions 2.1, 2.2 of the high pressure bore 2 counteract a leakage. This is because the pressure p1 prevails on the inner circumferential side on the sleeve 7.1 which is flowed through by the fuel to be injected, and the pressure p2 prevails on the outer circumferential side on the sleeve 7.2. The wall of the sleeve 7.1 is pressed against the wall of the sleeve 7.2 on account of the pressure difference. In addition, the sleeve 7.1 can experience radial widening in a manner which is dependent on the pressure p1. In order that the sleeve 7.1 is flowed through by the fuel to be injected, an annular space 9 which is part of the flow path of the fuel to be injected is configured between the sleeve 7.1 and the nozzle needle 1.

The contact region 18 of the sleeve 7.1 on a plate-shaped body component 11 of the fuel injector represents a further sealing location which is in principle afflicted by leakage. Since, however, the spring 5 is supported on the collar section 10 of the sleeve 7.1 in the present case, the spring force of the spring 5 presses the sleeve 7.1 against the body component 11. Moreover, the pressure p1 which brings about an additional hydraulic force in the direction of the body component 11 prevails on that end face of the sleeve 7.1 which faces away from the contact region 18. In the present case, the end face of the sleeve 7.1 at the same time forms a stroke stop 13 if, during opening of the needle, the sleeve 7.2 passes into contact via its bottom region 15 with that end face of the sleeve 7.1 which serves as a stroke stop 13.

The nozzle needle 1 of the nozzle assembly which is shown is of stepped configuration and has a section 12 with a reduced external diameter for receiving the multiple-piece throttle bore body 7 and for configuring the annular shoulder 8, on which the pot-shaped sleeve 7.2 of the throttle bore body 7 is supported. The fuel to be injected flows past said section 12 of the nozzle needle 1 in the direction of the closing throttle 6, and passes via the closing throttle 6 into the second part region 2.2 of the high pressure bore 2. The flow direction of the fuel is indicated by means of the arrows 19.

The invention claimed is:

1. A nozzle assembly for a fuel injector having a nozzle needle (1) which is received in a high pressure bore (2) of a nozzle body (3) such that the nozzle needle can perform stroke movements in order to open and close at least one injection opening (4) and is loaded in the closing direction at least indirectly by the spring force of a spring (5), the nozzle needle (1) being at least partially surrounded by a throttle bore body (7) in order to configure at least one closing throttle (6), characterized in that the throttle bore body (7) is configured in multiple pieces and comprises at least first and second sleeves (7.1, 7.2) which are at least partially guided into one another, and in that the second sleeve (7.2), which is arranged closer to the injection opening (4), is of substantially pot-shaped configuration and at least partially surrounds the first sleeve (7.1).

2. The nozzle assembly as claimed in claim 1, characterized in that the closing throttle (6) is configured in the second sleeve (7.2), which is arranged closer to the injection opening (4).

3. The nozzle assembly as claimed in claim 1, characterized in that the second sleeve (7.2), which is arranged closer to the injection opening (4), is supported in the axial direction on a shoulder (8) of the nozzle needle (1).

4. The nozzle assembly as claimed in claim 3, characterized in that the second sleeve (7.2) is loaded by the spring force of the spring (5) in a direction of the shoulder (8) of the nozzle needle (1).

5. The nozzle assembly as claimed in claim 1, characterized in that an annular space (9) is configured between the nozzle needle (1) and the first sleeve (7.1) which is arranged less closely to the injection opening (4).

6. The nozzle assembly as claimed in claim 1, characterized in that the first sleeve (7.1) has a collar section (10) for housing-side support.

7. The nozzle assembly as claimed in claim 1, characterized in that the spring (5) is arranged so as to lie radially on the outside in relation to at least one of the first and second sleeves (7.1).

8. The nozzle assembly as claimed in claim 1, characterized in that the nozzle needle (1) is of stepped configuration.

9. The nozzle assembly as claimed in claim 1, characterized in that the sleeves (7.1, 7.2) interact so as to form a stroke stop (13).

10. A fuel injector for injecting fuel into the combustion chamber of an internal combustion engine, the fuel injector comprising a nozzle assembly as claimed in claim 1, the throttle bore body (7) being supported via one of the sleeves (7.1, 7.2) on a body component (11) of the fuel injector.

11. The nozzle assembly as claimed in claim 1, characterized in that the closing throttle (6) is configured in the second sleeve (7.2), which is arranged closer to the injection opening (4), as an axially or obliquely running bore.

12. The nozzle assembly as claimed in claim 1, characterized in that the second sleeve (7.2), which is arranged closer to the injection opening (4), is supported in the axial direction on an annular shoulder (8) of the nozzle needle (1).

13. The nozzle assembly as claimed in claim 12, characterized in that the second sleeve (7.2) is loaded by the spring force of the spring (5) in a direction of the annular shoulder (8) of the nozzle needle (1), the spring (5) being supported on an annular end face (14) of the sleeve (7.2).

14. The nozzle assembly as claimed in claim 1, characterized in that the first sleeve (7.1) has a radially outwardly extending collar section (10) for housing-side support, the first sleeve (7.1) being mounted in the high pressure bore (2) in a radially floating manner.

15. The nozzle assembly as claimed in claim 1, characterized in that the nozzle needle (1) is of stepped configuration, in order to configure an annular shoulder (8), a section (12) of the nozzle needle (1) which is surrounded by the throttle bore body (7) being configured with a reduced external diameter.

16. A fuel injector for injecting fuel into the combustion chamber of an internal combustion engine, the fuel injector comprising a nozzle assembly as claimed in claim 1, the throttle bore body (7) being supported via one of the sleeves (7.1, 7.2) on a plate-shaped body component (11) of the fuel injector.

* * * * *